United States Patent [19]

Legeai

[11] 4,450,658

[45] May 29, 1984

[54] UNITIZED PARTITION WALL SYSTEM

[75] Inventor: Gilbert E. Legeai, Strasbourg, France

[73] Assignee: Hauserman, Inc., Cleveland, Ohio

[21] Appl. No.: 337,711

[22] Filed: Jan. 11, 1982

[51] Int. Cl.[3] ..... E04D 15/00

[52] U.S. Cl. ..... 52/126.3; 52/127.7; 52/240; 52/241

[58] Field of Search ..... 52/242, 240, 241, 126.3, 52/127.7, 127.8, 127.5, 122.1, 126.4; 49/395

[56] References Cited

U.S. PATENT DOCUMENTS

| | | | |
|---|---|---|---|
| 2,969,565 | 1/1961 | Levy | 52/126.4 |
| 3,033,330 | 5/1962 | Fowles et al. | 52/241 X |
| 3,305,983 | 2/1967 | Bus | 52/241 X |
| 3,386,216 | 6/1968 | Zwickert | 52/242 X |
| 3,400,504 | 9/1968 | Neisewander | 52/126.3 |
| 3,638,376 | 2/1972 | Howes et al. | 52/126.4 |
| 4,103,463 | 8/1978 | Dixon | 52/241 X |
| 4,277,920 | 7/1981 | Dixon | 52/241 X |

*Primary Examiner*—Carl D. Friedman

*Attorney, Agent, or Firm*—Maky, Renner, Otto & Boisselle

[57] ABSTRACT

A full height partition wall system is characterized by a unitary panel with a vertically movable head panel and a vertically movable foot panel secured thereto and forming a part thereof adapted to be moved upwardly and downwardly, respectively, to secure the panel to and directly against a ceiling and floor, respectively. The system has no posts, but rather a narrow vertical on each end of the panel which has an outwardly directed relatively shallow channel at the top in which is positioned a strut supporting the corresponding end of the head panel. A drive in the form of a small cog is operative vertically to move the strut and thus the head panel, with a spring detent member holding the strut in adjusted position. An adjustable foot is secured to the bottom of each vertical and the foot panel is spring loaded against the bottom of the foot for movement either with the bottom of the foot or movement independently against the spring loading. The vertical further has laterally directed edge flanges flush with the open end of the channel and adapted to be held to juxtaposed edge flanges of an adjacent panel to form a partition wall, and lateral access may be had to the strut drive for vertical adjustment of the head panel without disassembly of the partition wall. The panels include metal face plates formed with locating flanges at inwardly bent vertical edges thereof which cooperate with lateral stops on the vertical properly to position on the face plates the vertical forming the vertical edge of the panel.

62 Claims, 18 Drawing Figures

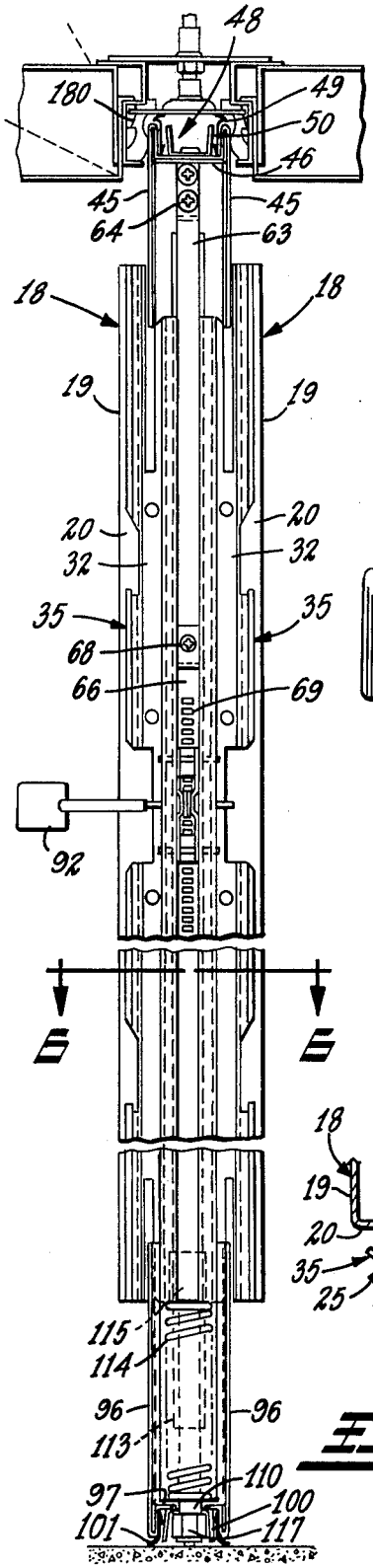
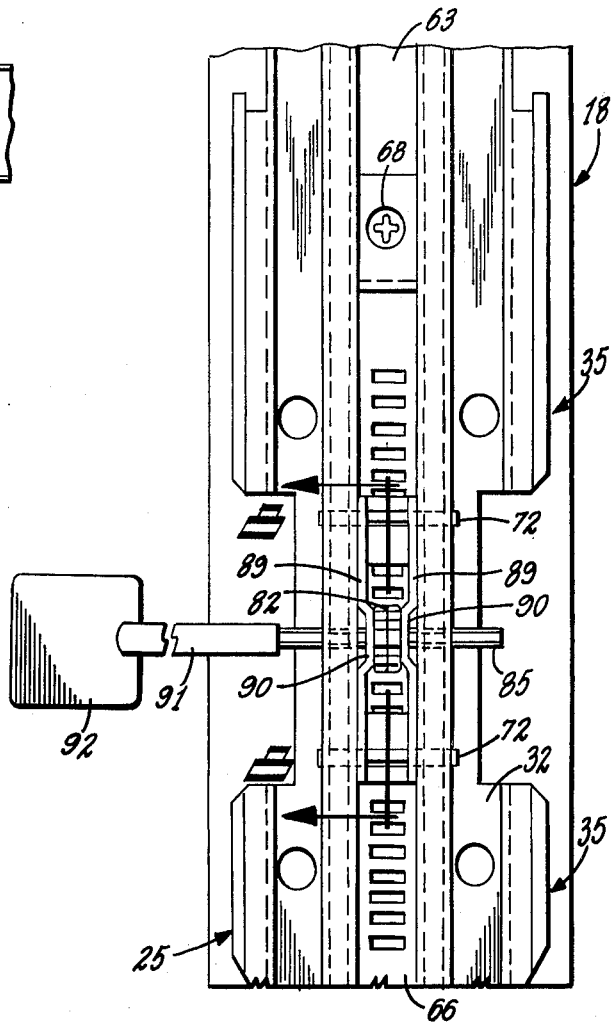
Fig. 7
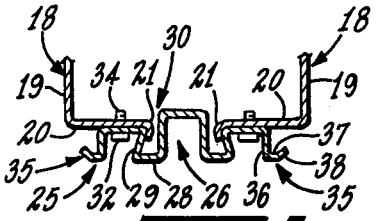
Fig. 6
Fig. 5
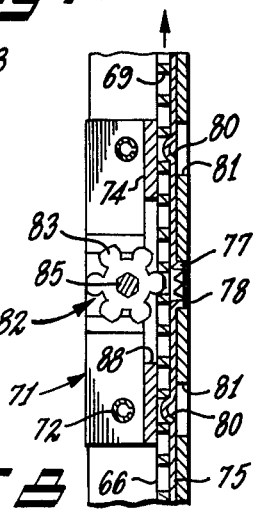
Fig. 8

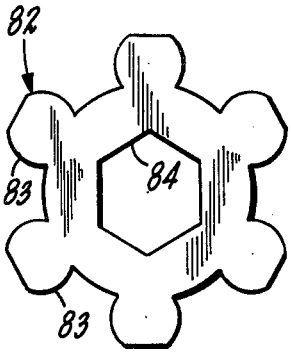
FIG. 9
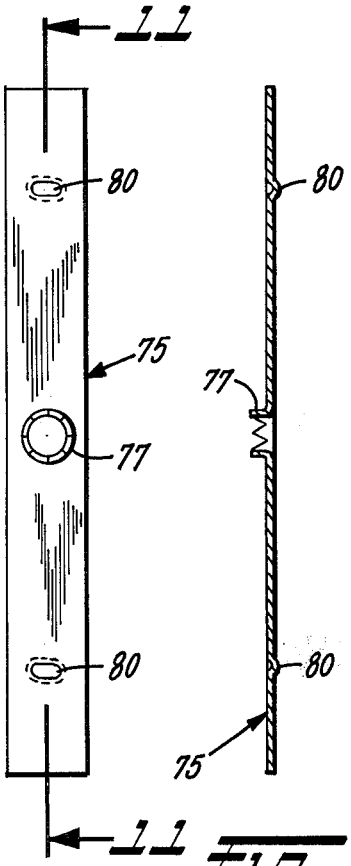
FIG. 11
FIG. 10
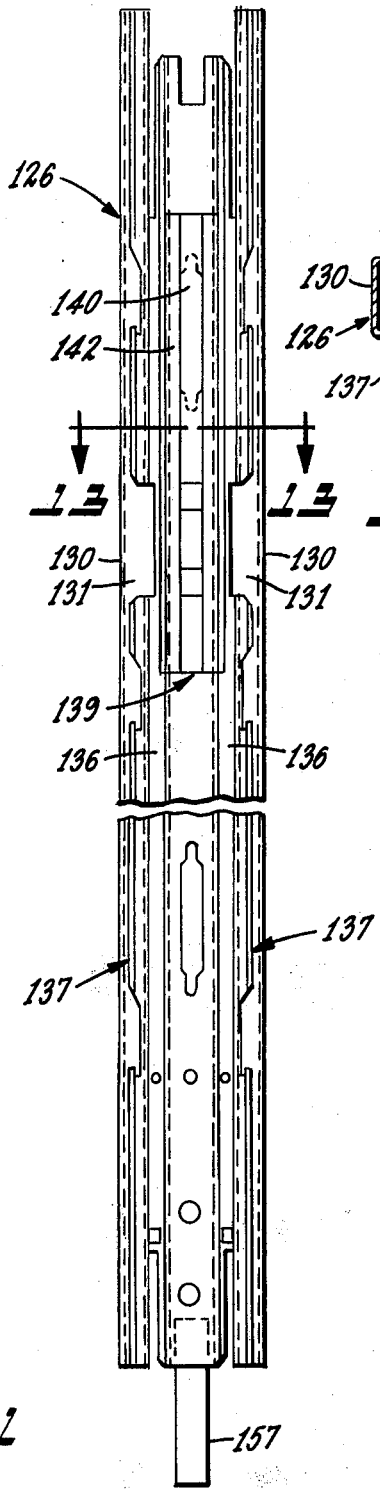
FIG. 12
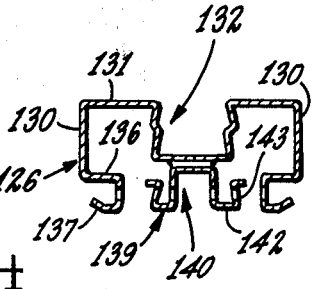
FIG. 13

UNITIZED PARTITION WALL SYSTEM

This application relates generally to the art of interior partition wall systems and more particularly to a full height, post-less partition panel assembly and wall.

BACKGROUND OF THE INVENTION

In previous partition systems, individual panels with various head and base assemblies have been assembled to make up a composite full height partition wall. Commonly, the individual panels were interconnected in edge abutting relationship by interconnecting components such as posts or the like and typically U-shaped posts that are received in channels at opposite vertical edge portions of adjacent panels. Such partition systems employing posts, however, are generally undesirable because of the need to provide and install the posts and associated hardware, such adding considerably to the expense of the partition system. Moreover, the head and base assemblies have been auxillary components separate and apart from the panel and, thus, require separate handling and assembly in the partition wall.

Known partition systems also have employed continuous lengths of channel attached to the ceiling or ceiling supports and the floor, respectively, for supporting the tops and bottoms of the individual panels of the partition wall. It also is known to provide each panel making up the partition wall with a slidable head member which is extended upwardly by a mechanical or pneumatic mechanism to adjust for different ceiling heights and any uneveness that may be encountered. A desirable form of adjustable head assembly in a panel is disclosed in applicant's assignee's copending patent application Ser. No. 949,133, filed Oct. 6, 1978, and entitled "Partition Head Assembly for Partition Wall Panel." The head assembly disclosed in this application is particularly desirable because it may be employed in a post-less system such as that more particularly described in applicant's assignee's U.S. Pat. No. 4,251,968, issued Feb. 24, 1981.

SUMMARY OF THE INVENTION

The present invention is directed to a unique full height interior partition wall system characterized by a unitary panel with a vertically movable head panel and a vertically movable foot panel secured thereto and forming a part thereof, and adapted to be moved upwardly or downwardly, respectively, to secure the panel to and directly against a ceiling and floor, respectively. The system has no posts, but rather a narrow vertical on each end of the panel which has an outwardly directed, relatively shallow channel at the top in which is positioned a strut supporting the corresponding end of the head panel. A drive in the form of a small cog is operative vertically to move the strut and thus the head panel, with a spring detent member holding the strut in adjusted position. The vertical further has laterally directed edge flanges flush with the open end of the channel and adapted to be held to juxtaposed edge flanges of an adjacent panel to form a partition wall, and lateral access may be had to the strut drive for vertical adjustment of the head panel without disassembly of the partition wall.

According to the preferred construction, the cog is journaled for rotation within the channel and cooperative with a series of vertically equally spaced holes in the strut at its lower end to drive the strut and thus the head panel vertically. The lower end of the strut is confined within the channel between the cog and the spring detent member, and the spring detent member cooperates with the holes in the strut to hold the strut in vertically adjusted position. In its preferred form, the spring detent member includes a thin spring plate in the bottom of the channel having one or more detents cooperative with the holes in the strut, and the bottom of the channel opposite the detents includes reliefs or openings adjacent the detents permitting the spring detent member to flex as the strut is driven therepast.

Further in accordance with the preferred construction, the channel is an integral part of the vertical forming the vertical edge of the panel or alternatively is secured to the upper portion of the vertical. In one form of panel, the channel may be received between locating or abutment flanges at the inwardly bent vertical edges of metal panel face plates and the vertical may have lateral stops cooperating with such locating flanges properly to position the vertical on the face plates.

According to another aspect of the invention, an adjustable foot is secured to the bottom of each vertical and the foot panel is spring loaded against the bottom of the foot for movement either with the bottom of the foot or movement independently against the spring loading. The panel in a partition wall is vertically adjustably supported by the adjustable feet on a floor and the foot panel is urged downwardly by the spring loading into secure engagement with the floor.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 5 is an enlarged end elevation of the solid panel of FIG. 1 as assembled between a ceiling and floor;

FIG. 6 is an enlarged fragmentary section taken on the line 6—6 of FIG. 5;

FIG. 7 is a fragmentary enlargement of FIG. 6;

FIG. 8 is a fragmentary vertical section taken substantially on the line 8—8 of FIG. 7;

FIG. 9 is an enlarged plan view of a cog employed in the panels of FIGS. 1 and 2;

FIG. 10 is an enlarged plan view of a spring detent member employed in the panels of FIGS. 1 and 2;

FIG. 11 is a section through the spring detent member of FIG. 10 taken on the line 11—11 thereof;

FIG. 12 is an enlarged end elevation of a vertical forming a vertical edge of the glass panel of FIG. 2;

FIG. 13 is a horizontal section through the vertical of FIG. 12 taken on the line 13—13 thereof;

DETAILED DESCRIPTION

Figure 1:
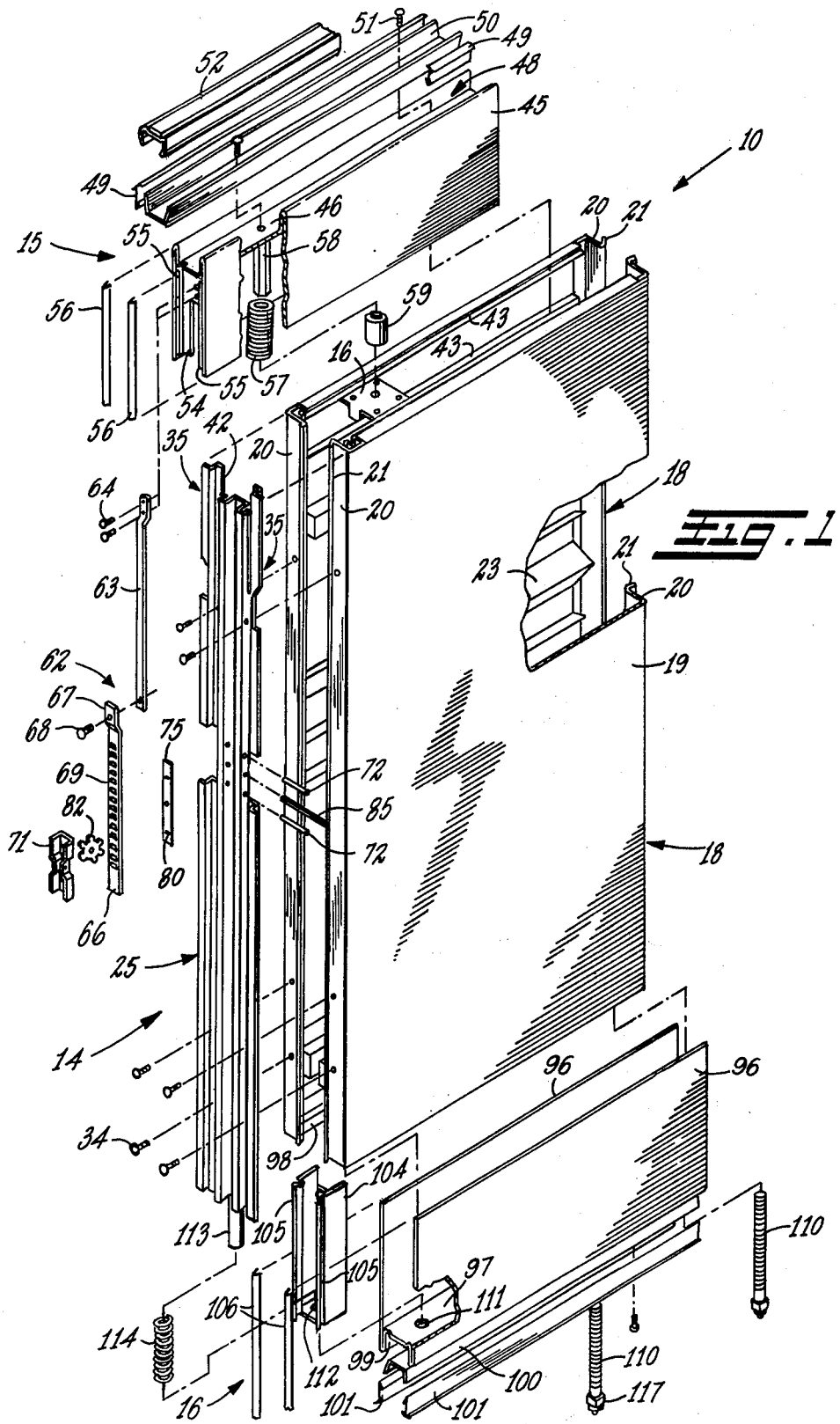
FIG. 1 is a fragmentary, exploded, partly broken away, perspective illustration of a solid panel constructed in accordance with the present invention.
Figure 2:
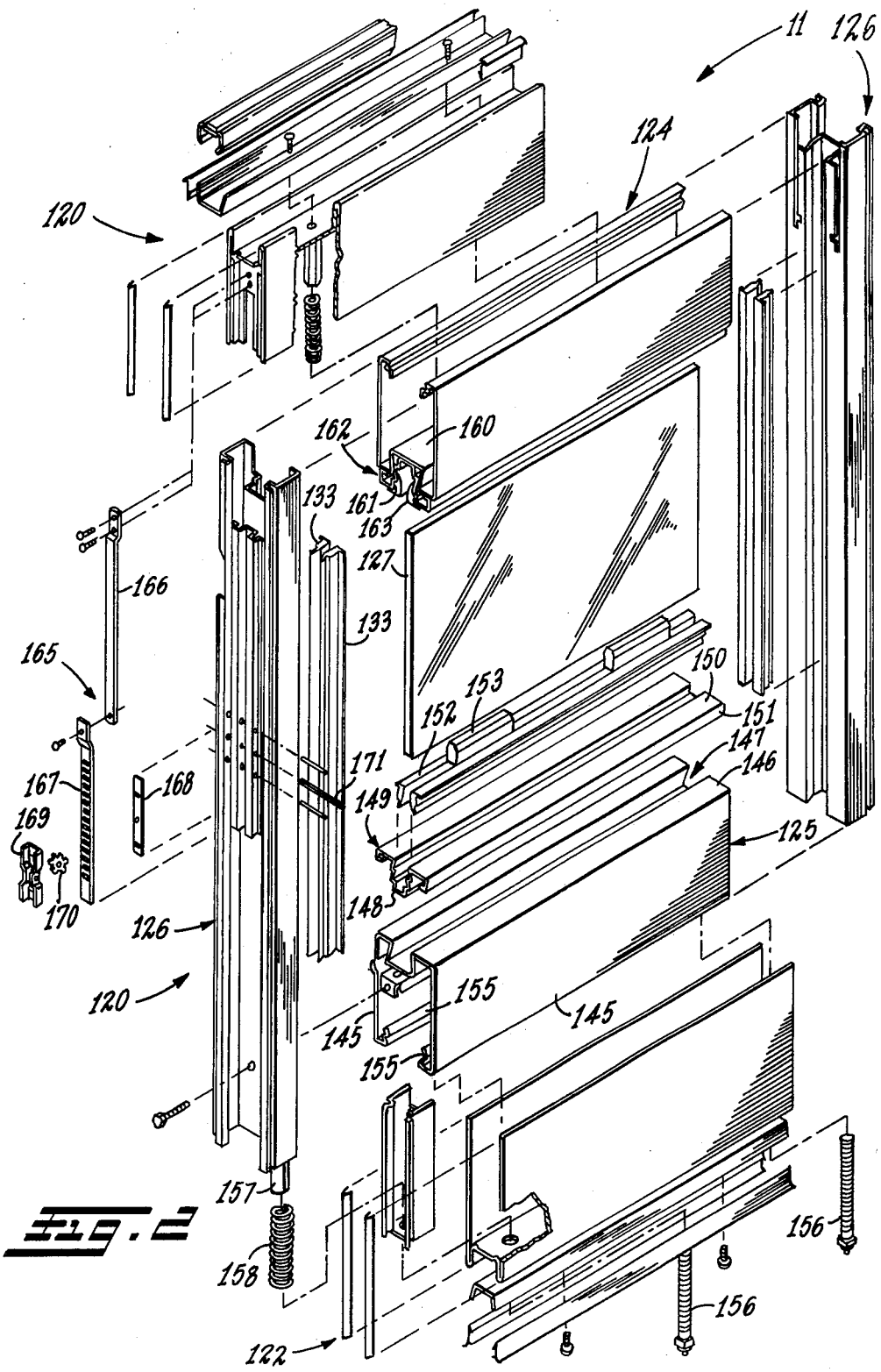
FIG. 2 is a fragmentary, exploded, partly broken away, perspective illustration of a glass panel constructed in accordance with the present invention.
Figure 3:
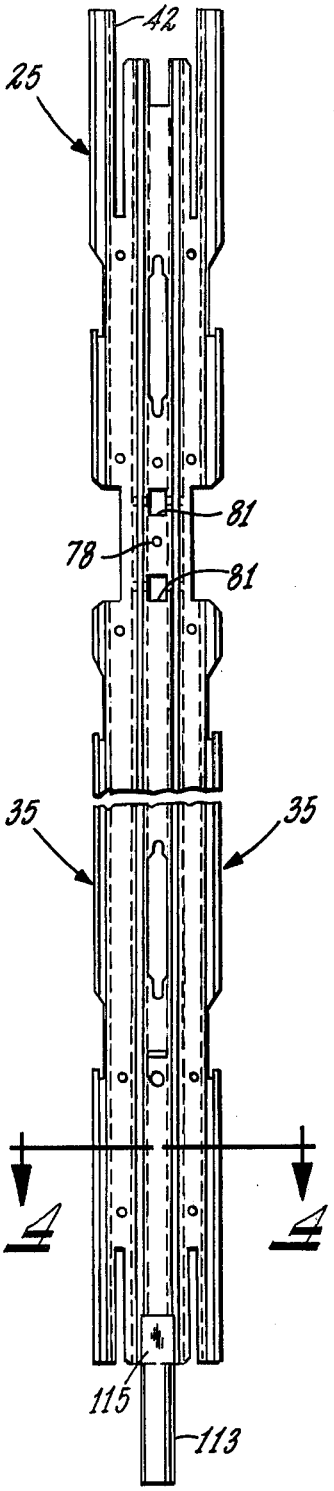
FIG. 3 is an enlarged elevation of a vertical forming a vertical edge of the solid panel of FIG. 1 as such would be seen from the interior of the panel.

Referring now in detail to the drawings, two different forms of partition panels constructed in accordance with the invention are illustrated in FIGS. 1 and 2. In FIG. 1, a full height solid panel is designated generally by reference numeral 10 whereas in FIG. 2, a full height glass panel is designated generally by reference numeral 11. Although only the solid and glass panels 10 and 11 are shown and described hereinafter, it will be appreciated that the principles of the invention may be employed in other forms and types of panels such as in door frame, utility and filler panels.

The Solid Panel 10

As seen in FIG. 1, the solid panel 10 generally consists of a panel body 14, a vertically movable head panel 15 and vertically movable base or foot panel 16. The vertically movable head panel 15 and foot panel 16 are secured to the panel body 14 and form a part thereof or, more accurately, the overall panel 10. In addition, the head and foot panels are adapted to be moved upwardly and downwardly to secure the panel to and directly against a ceiling and floor, respectively.

1. The Panel Body 14.

Referring now additionally to FIGS. 3–6, the panel body 14 is constructed from a pair of substantially parallel spaced apart metal face plates 18 which preferrably are made of thin gauge sheet metal. The face plates 18 have substantially rectangular planar central face portions 19 and opposite end or edge portions which are bent inwardly to define web portions 20. The web portions 20 run the full height of the face plates 18 and extend substantially perpendicularly to the central face portions 19. As best seen in FIG. 6, each edge portion of the face plates 18 further may be bent outwardly from the web portion 20 to define a terminal locating flange 21 which preferrably forms an acute angle with the respective web portion 20.

The face plates 18 are reversely positioned with the central face portions 19 thereof being parallel and spaced apart, and with the locating flanges 21 being spaced apart as well. The space between the central face portions 19 of the face plates 18 may be filled with suitable fill and sound insulating material such as rock wool, foamed plastics, etc., and/or a honeycomb or rib structure 23 may be provided therein to reinforce the central face portions 19.

Each vertical edge of the panel body 14 is formed by a vertical 25 which is secured to and interconnects the laterally spaced web portions 20 of the face plates 18. The vertical 25 preferably is of a heavier gauge sheet metal than the face plates 18 and, when bent and secured to the face plates as indicated, provides a very strong panel edge capable of serving as a structural supporting member itself so that the panel can be used with or without structural posts in a partition wall system.

As seen in FIGS. 3–6, the vertical 25 is bent fo form a U-shape, relatively shallow, central channel 26 which is outwardly directed in relation to the panel edge and received between the spaced locating flanges 21 of the face plates 18. At the open end of the central channel 26, the vertical 25 is bent outwardly substantially perpendicularly to the legs of the central channel to form laterally extending flange portions 28 and then inwardly therefrom to define stop flange portions 29. As seen in FIG. 6, the stop flange portions 29 are adapted to engage or abut the locating flanges 21 of the face plates 18 so as to locate or properly space the web portions 20 of the face plates and properly position the vertical 25 thereon. As shown, the stop flange portions 29 and locating flanges 21 preferrably form like acute angles with the respective web portions 20 of the face plates 18. It also can be seen that the laterally extending and stop flange portions 28 and 29 together form, with the respective legs of the central channel 26, inwardly directed channels 30 adapted to receive, locate and accommodate the locating flanges 21 of the face plates 18.

The vertical 25 is further bent outwardly from the stop flange portions 29 to form webs 32 which are butted against the corresponding web portions 20 of the face plates 18. The webs 32 and web portions 20 are provided top and bottom with aligned holes 33 for recepit of screw fasteners 34 which secure the vertical 25 to the face plates 18 and maintain such in asssembled relationship. It however will be appreciated that means other than the screw fasteners 34 may be employed to secure the vertical 25 and face plates 18 together.

Figure 4:
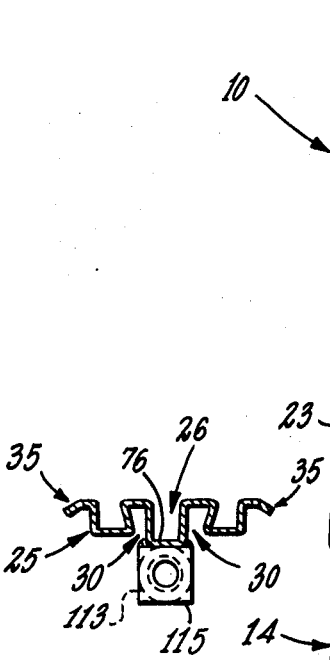
FIG. 4 is an enlarged horizontal section through the vertical of FIG. 3 taken on the line 4—4 thereof.

The vertical 25 is still further bent outwardly from the webs 30 to define J or L-shape edge flanges or projections 35 which are recessed in relation to the planar extent of the central face portions 19 of the face plates 18. The edge flanges 35 each have a long stem portion 36 extending normal to the respective web 32, a base portion 37 extending outwardly normal to the long stem portion 36, and if desired a short stem portion 38 extending inwardly from the base portion 37 and outwardly from the long stem portion 36. As seen in FIGS. 4 and 6, the base portions 37 of the edge flanges 35 and extend laterally and are flush or coplanar with the laterally extending flange portions 28 and hence with the open end of the central channel 26. This enables adjacent panels to be placed in edge abutting relationship to form a partition wall with opposed edge flanges 35 and opposed laterally extending flange portions 28 juxtaposed so that such adjacent panels then may be then readily joined together in the preferred manner discussed hereinafter.

As should be apparent from FIG. 1, the vertical 25 is cut back at its top end to form a recess 42 between the edge flanges 35 thereof. The recess 42 is adapted to accomodate the head panel 15. The face plates 18 also can be seen in FIG. 1 to have inwardly and downwardly bent flanges 43 along the upper edges thereof for stiffening purposes and for telescopically receiving the head panel 15 in the top of the panel body 14.

2. The Head Panel 15.

Referring now in particular to FIGS. 1 and 5, the head panel 15 can be seen to comprise a pair of substantially parallel face portions 45 which are maintained in spaced apart relationship by a central portion 46 and extend substantially the width of the face plates 18. The face portions 45 and central portions 46 of the head panel 15 define, respectively, the sides and base of a top channel 48 running substantially the full width of the head panel along its upper edge. Positioned within the upwardly opening top channel 48 at each side thereof is a ceiling trim seal 49 adapted to form a light and sound barrier with a ceiling or ceiling element when brought into engagement therewith. The ceiling trim seals 49 are telescopically held in the top channel 48 by a U-shape keeper 50 secured in the channel by fasteners 51. There optionally may be provided in the U-shape keeper 50 a ceiling stop element 52 adapted to engage and hold the head panel to a ceiling surface against lateral slipage.

Each edge of the head panel 15 is formed by an edge piece 54 which is U-shape in horizontal cross-section. The legs of the edge piece 54 are secured to the inner surfaces of the respective face portions 45 and have vertical clip flanges 55 cooperating with the face portions 45 to hold head panel edge trim seals 56. The edge trim seals 56 are adapted to engage the edge trim seals of an adjacent head panel to form a light and sound barrier therebetween.

The head panel 15 is resiliently supported at each end by a coil spring 57 on the panel body 14. The spring 57 is positioned about and guided by an upper spring guide 58 depending from the central portion 46 of the head panel and a lower spring guide 59 mounted on top of a horizontal plate 16 secured between the central face portions 19 of the face plates 18.

Referring now additionally to FIGS. 7–11, each end of the head panel 15 also is supported for vertical height adjustment by a strut 62. The strut 62 includes an upper strut extension 63 secured at its top end to the edge piece 54 of the head panel 15 by fasteners 64. The strut extension 63 extends downwardly from the head panel and is dimensioned to be received for sliding vertical movement in the central channel 26 of the vertical 25, such central channel preventing lateral displacement or movement of the strut extension relative to the vertical 25. The strut extension 63 should not extend outwardly beyond the open end of the central channel 26 as such would preclude securement of adjacent panels in the manner hereinafter described.

The strut 62 further includes a thin elongate strut rack 66 secured at its outwardly offset upper end 67 by a fastener 68 to the lower end of the strut extension 63. The strut rack 66 also is received and guided for vertical movement in the central channel 26 with such channel precluding lateral displacement or movement of the rack relative to the vertical 25. For purposes that will become more apparent below, the strut rack has a plurality of vertically equally spaced holes 69 extending therethrough.

The strut rack 66 is held or captured in the central channel 26 of the vertical 25 by an elongate, U-shaped keeper or retainer 71. The keeper 71 is fully contained within the central channel 26 and is fixed top and bottom therein by pin fasteners 72 passing through aligned holes in the legs of the keeper 71 and the channels 26 and 30. The pin fasteners 72 may be press fitted in at least one of such aligned holes so as to be held in place.

As best seen in FIG. 8, the bottom or bight portion 74 of the keeper 71 abuts and bears against the strut rack 66 and holds it against a spring detent member 75 positioned in the bottom of the central channel 26. The spring detent member 75 preferrably is made of a thin, elongate flat piece of spring steel which has a central inwardly directed boss 77 punched therefrom. The boss 77 cooperates with an aligned opening 78 in the bottom 76 of the central channel 26 to hold the spring detent member against vertical movement in the central channel.

The spring detent member 75 also is provided with at least one outwardly directed detent or dimple 80 adapted to be engaged in a hole 69 of the strut rack 66 so as to hold the strut rack in one of a number of vertically adjusted positions. As shown, two such dimples are provided and vertically spaced a multiple of the spacing between adjacent holes 69 in the strut rack so that in any one vertically adjusted position, both dimples are engaged in holes. In order to permit vertical adjustment of the strut rack and thus the head panel 15, reliefs or openings 81 are provided at the bottom 76 of the central channel 26 opposite the dimples 80 thereby permitting the spring detent member 75 to flex in the area of the dimples as the rack is driven therepast by the strut drive 82.

As best seen in FIG. 9, the strut drive 82 is in the form of a cog that has a number of circumferentially equally spaced teeth 83 having arcuate radial sides and flat radially outer ends. The cog further has a hexagonal axial center bore 84 adapted to be press fitted or otherwise secured on a drive shaft 85 of similar hexagonal cross section.

As seen in FIGS. 7 and 8, the cog 82 is journaled for rotation in the central channel 26 of the vertical 25 by means of the drive shaft 85 and keeper 71. More particularly, the cog 82 is located substantially in the bight of the keeper 71 with the inwardly disposed teeth 83 thereof projecting through a slot 88 in the bottom 74 of the keeper into operative driving engagement with a hole or holes 69 in the strut rack 66. It thus can be appreciated that rotation of the cog in one direction will drive the strut rack and thus the head panel 15 vertically upwardly whereas rotation in the other direction will drive the strut rack and thus the head panel vertically downwardly.

The cog 82 may have an axial thickness less than the spacing between the legs 89 of the keeper 71, and such legs 89 may be provided with bosses or inward deviations 90 taking up the difference in spacing whereby the cog is held laterally in alignment with the holes 69 in the strut rack 66. The ends of the drive shaft 85 extend laterally through guide holes in such bosses 90 and through axially aligned holes, slots or the like in the legs of the channels 26 and 30. The lateral terminal ends of the shaft 85 also project beyond the channels 26 and 30 a sufficient distance for receipt of the socket head 91 of a key or crank 92. The socket head 91 of the key 92 may include a hexagonal socket adapted to be slipped on and drivingly engaged with the terminal end of the hexagonal drive shaft 85 for effecting rotation of the cog upon rotation of the key. Preferrably, the drive shaft projects from both sides of the channels 26 and 30 so that the key may be engaged therewith on either side of the panel 10. As will be appreciated below, the terminal ends of the shaft 85 preferably do not extend beyond the lateral extent of the edge flanges 35 on the vertical 25, and such edge flanges 35 may be relieved or slotted in the area of the rack drive as shown. This facilitates assembly of the keeper 71 and cog in the vertical 25. However, the edge flanges 35 may be provided with suitable holes, slots or the like as required to permit assembly of the keeper and cog as well as to provide access for coupling of the key 92 on either end of the drive shaft 85.

Before leaving the description of the strut and drive therefor, it should be appreciated that the strut 62, keeper 71, spring detent member 75 and cog 82 are fully contained within the central channel 26 of the vertical 25 forming the edge of the panel 10. That is, such components do not extend outwardly beyond the open end of the central channel 26 whereby adjacent panels may be brought into and connected together in close butted edge relationship as will be described more particularly hereinafter.

3. The Foot Panel 16.

Referring now in particular to FIGS. 1 and 5, the foot panel 16 can be seen to comprise a pair of substantially parallel face portions 96 which are maintained in spaced-apart relationship by a central portion 97. The face portions extend substantially the width of the central face portions 19 of the face plates 18 and are telescopically received between inwardly and upwardly bent flanges 98 along the lower edges of the central face portions 19. The face portions 96 and central portion 97 define a bottom channel 99 which opens downwardly and runs substantially the width of the foot panel along its lower edge. Secured within the bottom channel 99 by a U-shape keeper 100 are floor trim seals 101 which project beyond the bottom edge of the foot panel and are adapted sealingly to engage the floor to provide a sound and light barrier.

Each vertical edge or end of the foot panel 16 is formed by an edge piece 104 which is U-shape in horizontal cross section. The legs of the edge piece 104 are secured to inner surfaces of the face portions 96 of the foot panel and have vertical clip flanges 105 formed at their terminal vertical ends cooperating with the face portions 96 to hold foot panel edge trim seals 106. The foot panel edge trim seals 106 are adapted to engage opposed trim seals of an adjacent foot panel to form a light and sound barrier therebetween.

The foot panel 16 is guided at each end for vertical movement along an adjustable foot 110 which closely passes through holes 111 and 112 provided in the central portion 97 and bottom of the edge piece 104, respectively. The adjustable foot 110 is adjustably threadably received in a tubular vertical depending extension or post 113 secured to the bottom of the vertical 25. As seen in FIG. 4, the post is secured to the vertical 25 at the bottom 76 of the central channel 26.

Positioned about and guided by the post 113 and adjustable foot 110 is a coil spring 114 which is interposed between the square head 115 of post 113 secured to the vertical 25 and the central portion 97 of the foot panel 16. The coil spring 114 spring loads the foot panel into engagement with a stop which, for example, may be an adjustment nut 117 provided on the bottom of the adjustable foot 110 for movement with the foot, or the foot panel is movable independently of the foot against the spring loading. When the panel 10 is assembled in a partition wall and supported on a floor by the adjustable foot 110 as seen in FIG. 5, the coil spring 14 urges the foot panel 16 into secure engagement with the floor thereby to secure the panel against the floor along with the adjustable foot. As shown, the adjustable foot 110 may be provided at its lower end with a dimple or other projection adapted to lock the foot against lateral slippage when engaged with the floor.

The Glass Panel 11

Reverting now to FIG. 2, the glass panel 11 can be seen to include panel body 120, a vertically movable head panel 121 and a vertically movable base or foot panel 122. Like in the solid panel 10, the vertically movable head panel 121 and foot panel 122 are secured to the panel body 120 and form a part of the panel 11, and are adapted to be moved upwardly and downwardly, respectively, to secure the panel 11 to and directly against a ceiling and floor, respectively.

The panel 120 includes horizontal top and bottom panel members 124 and 125 which are secured between the tops and bottoms of verticals 126, respectively. The top panel member 124, bottom panel member 125 and verticals 126 form a rectangular frame surrounding and holding therein a glass pane 127.

Figure 14:
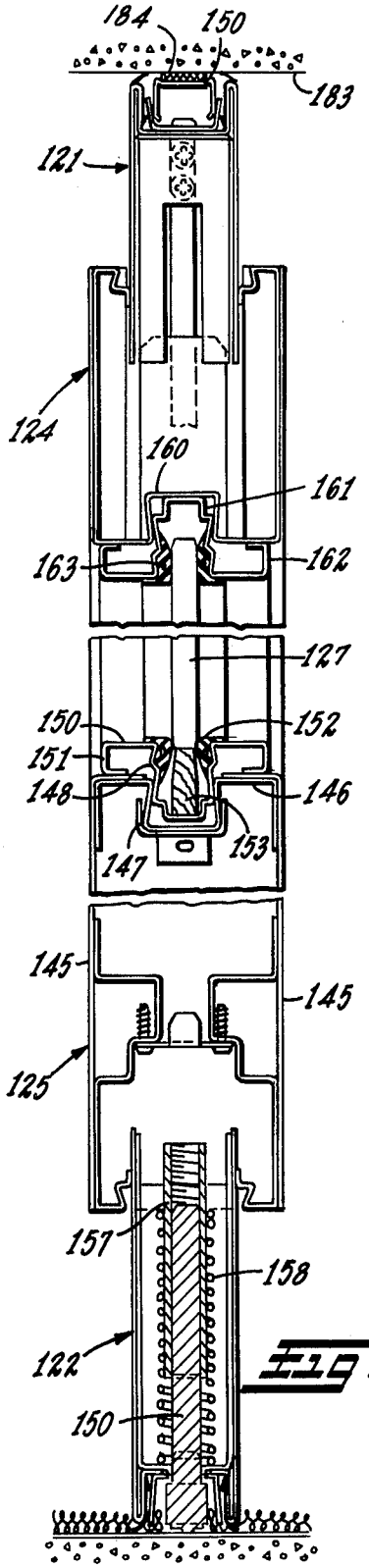
FIG. 14 is an enlarged, broken, vertical, schematic section through the glass panel of FIG. 2 as assembled between a ceiling and floor.

Referring now additionally to FIGS. 12–14, each vertical 126 can be seen to include a pair of substantially parallel faces 130 which are maintained in spaced relationship by a central portion 31 which extends generally laterally between the inner vertical edges of the faces 130. The central portion 131 includes a centrally disposed, stepped dovetail channel 132 which is inwardly directed for receipt of the vertical edge of the glass pane 127. The vertical edge of the glass pane 127 is held in the channel 132 by glazing strips 133.

The outer vertical edge portions of the faces 130 of the vertical 126 are bent inwardly to define web portions 136 and then outwardly from the web portions 136 to define L or J-shape edge flanges or projections 137. The web portions 136 extend perpendicularly to the faces 130 and the edge flanges 137 are formed similarly to the edge flanges 35 of the solid panel 10. Accordingly, the glass and solid panels may be used interchangeably in a partition system as will become more apparent from the hereinafter description of a partition wall.

Figure 16:
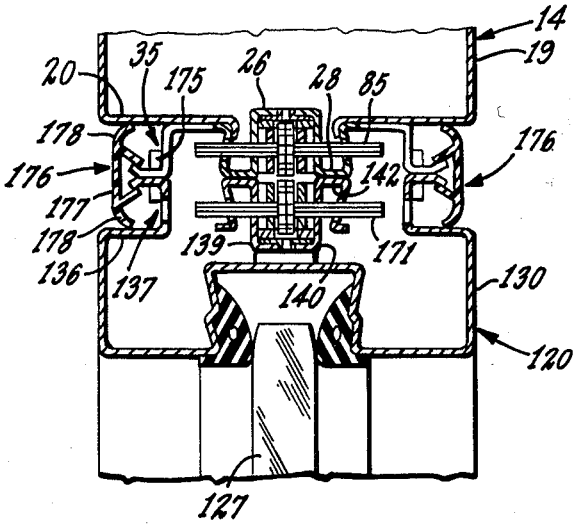
FIG. 16 is an enlarged fragmentary section through the edge butted panels of FIG. 15 taken substantially on the line 16—16 thereof.

The vertical 126 has secured at its upper end a relatively short vertical channel element 139 which includes a relatively shallow, U-shape central channel 140 which is outwardly directed in relation to the panel edge. The vertical channel element 139 is secured as by spot welding at the two vertically spaced reliefs 141, having the same vertical spacing as holes 81, at the bottom of its central channel 140 to the bottom of the dovetail channel 132. At the open end of the central channel 140, the vertical channel element 139 is bent outwardly substantially perpendicularly to the legs of the central channel to form laterally extending flange portions 142 and then inwardly from the flange portions 142 to define terminal flanges 143. As best seen in FIG. 16, the central channel 140 and flange portions 142 are dimensioned and shaped like the central channel 26 and flange portions 28 of the solid panel vertical 25 and are adapted to be positioned in butted opposed relationship as indicated.

Referring now in particular to FIGS. 2 and 14, the horizontal top and bottom panel members 124 and 125 can be seen to be of generally like construction but oppositely oriented. For the sake of brevity, only the bottom panel member 125 will be described in detail, it being appreciated that such description is generally applicable to the top panel member 124.

The bottom panel member 125 comprises a pair of substantially parallel faces 145 which are maintained in spaced relation by a central portion 146 which extends generally laterally between the upper edges of the faces 145. The central portion 146 includes an upwardly directed dovetail channel 147 which receives and holds a stepped dovetail channel 148 of a top piece 149. The top piece 149 is bent to form laterally extending flanges 150 flush with the open end of the dovetail channel 148 and further bent downwardly and then inwardly to define edge flanges 151 which engage the top of the center portion 146 of the bottom panel member 145 and thus support the top piece 149 with the bottom of the channel 148 spaced above the bottom of the channel 147 as seen in FIG. 14. As also seen in FIG. 14, the lower edge of the glass pane 127 is held in the stepped dovetail channel 148 by glazing strips 152 and supported on wooden blocks 153.

Still referring to FIGS. 2 and 14, the faces 145 of the bottom panel member 125 are bent inwardly and upwardly to form bent flanges 155 along their lower edges. The bent flanges 155 are spaced apart for telescopic receipt of the foot panel 122. The foot panel 122 is of like construction to the foot panel 16 of the solid panel 10 and therefore will not be further described. However, it is noted that the foot panel 122 is guided at each end for vertical movement along an adjustable foot 156 which is adjustably threadedly received in a depending, tubular vertical extension or post 157 secured to the bottom of the vertical 126. Positioned about and guided by the post and adjustable foot is a coil spring 158 which is interposed between the vertical 126 and foot panel 122 in the same manner as the coil spring 114 of the solid panel 10 is interposed between the vertical 25 and the foot panel 16.

As indicated, the horizontal top panel member 124 is generally of like construction to the horizontal bottom panel member 125 but oppositely oriented so that the dovetail channel 160 thereof and the stepped dovetail channel 161 of the bottom piece 162 are both directed downwardly. The top edge of the glass pane 127 is held in the stepped dovetail channel 161 by glazing strips 163. On the other hand, the upper end of the top panel member is open for telescopic receipt of the head panel 121. The head panel 121 is of like construction to the head panel 15 of the solid panel 10 and therefore will not be further described.

Vertical adjustment of the head panel 121 is obtained in substantially the same manner as vertical adjustment of the head panel 15 of the solid panel 10, there being provided a strut 165 including a strut extension 166 and a strut rack 167 both slidable vertically in the central channel 140 of the vertical 139. The strut rack 167 is held against a spring detent member 168 in the bottom of the central channel 140 by a keeper 169 and a cog 170 journaled in the channel is operative to drive the strut 165 vertically for vertical adjustment of the head panel 121. The detents or dimples of the spring 168 are positioned at and extend opposite the reliefs 141 to permit spring flexure. The cog is mounted on and for rotation with a drive shaft 171 which projects laterally through and beyond the vertical channel element 139 a sufficient distance to permit coupling of a removable crank or key thereon for effecting rotation of the cog.

The Partition Wall

Figure 15:
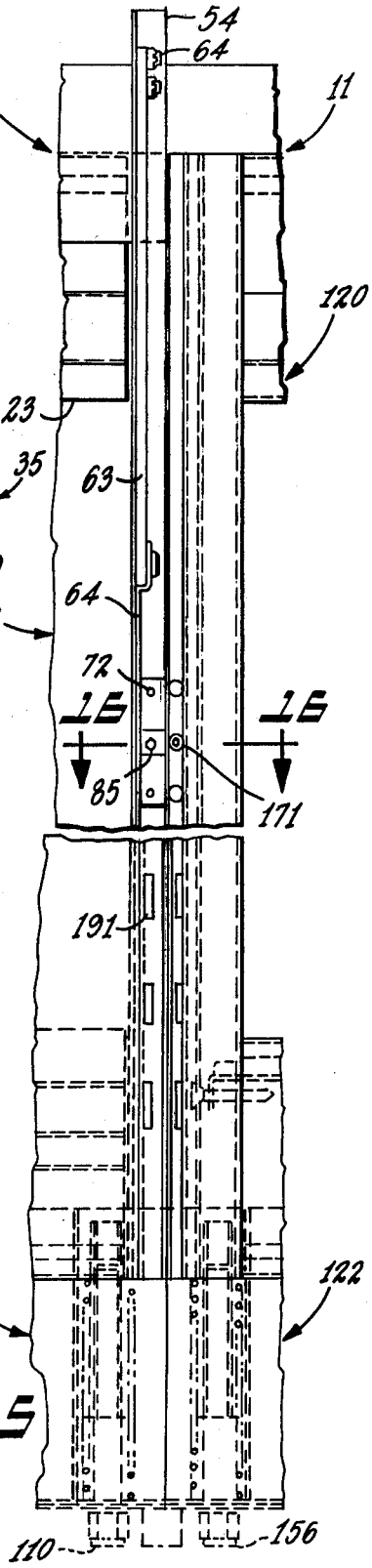
FIG. 15 is an enlarged fragmentary, broken elevation showing the panels of FIGS. 1 and 2 in edge abutting relationship and with parts thereof removed for illustrative purposes.

Referring now to FIGS. 15 and 16, the intersection of solid and glass panels 10 and 11 can be seen. The panels 10 and 11 are positioned in in-line relationship with the respective panel faces and the glass pane forming the partition wall surfaces. The edges of the panels are adjacent one another with opposed base portions of the recessed edge flanges 35 and 137 juxtaposed and secured together by clips 175. A light and sound sealing trim strip 176 is pressed on to the juxtaposed edge flanges, each trim strip including a generally U-shape central portion 177 embracing the flanges and flexible flanges or wings 178 which extend from the central portion 177 into engagement with the web portions 20 and 136 of the panels 10 and 11, respectively. Accordingly, the trim strips 176 overlie and conceal the interconnected edges of the panels. It also will be appreciated that the panels may be interconnected in the manner described in the aforementioned U.S. Pat. No. 4,251,968.

Before the panels 10 and 11 are interconnected, the respective adjustable feet 110, 156 thereof preferably are adjusted to match the respective vertical heights of the respective panel bodies 14, 120. This may be roughly done before the panels are positioned in place in the partition wall with any fine adjustments being made thereafter by elevating the respective foot panels 16, 122 to provide access to the adjustment nuts of the respective feet 110, 156. Once may fine adjustments are made, the foot panels 16, 122 are released whereby the foot panels will be urged downwardly by the spring loading into engagement with the floor as seen in FIGS. 5 and 14, respectively.

With the panel heights thusly properly adjusted, the respective head panels 15, 121, having previously been in their lowest position during assembly of the panels in the wall, may now be adjusted vertically upwardly into engagement with the ceiling or ceiling elements. As seen in FIG. 5, the top of the head panel 15 of solid panel 10 may be moved, for example, into a recess 180 common to integrated sealings with the ceiling trim seals 49 forming a light and sound barrier between the recess 180 and head panel 15. In FIG. 14, the head panel 121 is shown engaged with a flat ceiling surface 183. Again the ceiling trim seals form a light and sound barrier between the head panel 121 and the ceiling. In addition, there is provided the stop element 52 which has an inverted U-shape body received in the bight of the keeper 50. The bottom or top portion of the stop element 52 has secured on its top surface a rubber or fabric pad 184 adapted to engage and frictionally hold the head panel to the ceiling surface 183 whereby the top of the panel is secured to the ceiling against lateral movement.

Figure 17:
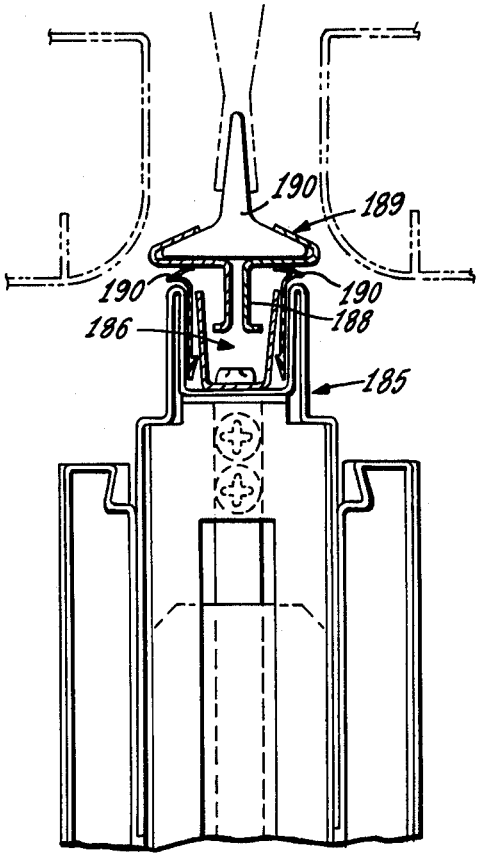
FIG. 17 is a fragmentary schematic section showing another form of panel head-ceiling interface.

In FIG. 17, another form of panel head-sealing interface is shown. Here, a modified head panel 185 has a reduced thickness top channel 186. When the head panel 185 is vertically adjusted upwardly into engagement with the ceiling, the top channel receives therein the downwardly projecting flanges 188 of clips 189 secured to a T-bar 190 of the ceiling. The projecting flanges 188 preclude lateral displacement of the head panel 185 and again, a light and sound barrier is formed between the head panel 185 and the ceiling by the ceiling trim seals 190.

Reverting to FIGS. 15 and 16, it should be apparent that vertical adjustment of the head panels 15 and 121 may be obtained either before or after the panels are interconnected at their edges and the trim strip 176 attached. With the trim strip already in place, the flexible wings 178 thereof permit insertion and coupling of the removable key onto either of the drive shafts 85 and 171. Access also may be had in like manner to vertical rows of slots 191 provided in the edge flanges 35 and 137 for hanging of accessories therefrom.

Figure 18:
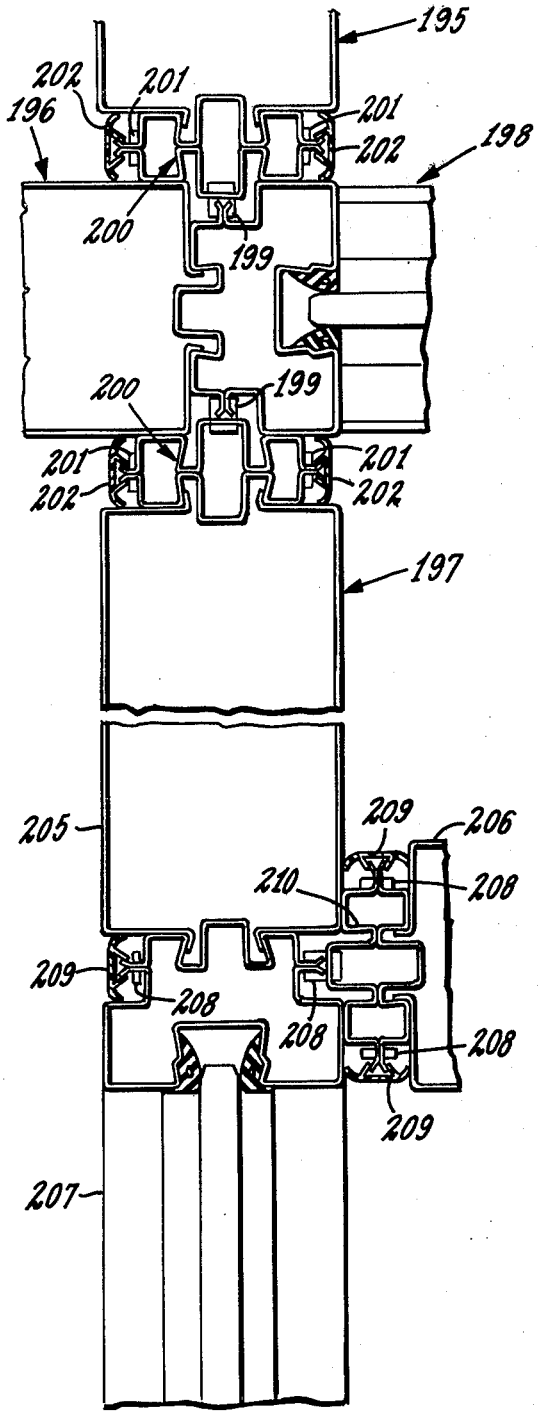
FIG. 18 is a fragmentary horizontal schematic section illustrating various panel intersections in a partition wall system.

Referring now to FIG. 18, various intersections of panels in a partition system are illustrated. At the top in FIG. 18, an exemplary 4-way intersection between solid panels 195–197 and glass panel 198 is shown. The solid panel 196 and glass panel 198 are secured in in-line relationship at their respective edge flanges by clips 199. To provide edge flanges to which the panel assemblies 195 and 197 can be connected, verticals 200 of a construction similar to the verticals 25 of the solid panel 10 are secured to the clips 199. The verticals 200 span the gap between the panels 196 and 198 and the panels 195 and 197 are secured at their respective edge flanges to the verticals 200 by clips 201. Also as shown, trim strips 202 are secured to the exposed juxtaposed edge flanges to conceal the interconnected edges of the panels and to provide sound and light barriers therebetween.

FIG. 18 also shows at the bottom thereof an exemplary a 3-way intersection between the solid panels 205 and 206 and a glass panel 207. The solid panel 205 and glass panel 207 are secured in in-line relationship at their respective edge flanges by clips 208 and 209. The clip 209 has secured thereto a vertical 210 which provides edge flanges to which the solid panel 206 can be secured by clips 208. Again, trim strips 209 are provided to conceal the interconnected edges of the panels and to provide sound and light barriers therebetween.

Although the invention has been shown and described with respect to certain preferred arrangements, it is obvious that equivalent alterations and modifications will occur to others skilled of the art upon the reading and understanding of this specification. The present invention includes all such equivalent alterations and modifications, and is limited only by the scope of the following claims.

The embodiments of the invention in which an exclusive property or privilege is claimed are defined as follows:

1. In a partition system, a panel, a vertical on each end of said panel, each vertical including an outwardly directed relatively shallow channel, a strut positioned in each said channel and supporting a corresponding end of an adjustable panel head, and drive means in each said channel operative vertically to move the corresponding strut and thus said head.

2. A system as set forth in claim 1 including spring means operative to hold said strut in adjusted position.

3. A system as set forth in claim 1 wherein said strut includes a series of equally spaced holes.

4. A system as set forth in claim 3 further including spring detent means cooperating with said holes to hold said strut in vertically adjusted position.

5. A system as set forth in claim 4 wherein said drive means cooperates with said holes to drive said strut vertically.

6. A system as set forth in claim 5 wherein said drive means comprises a cog journaled for rotation within said channel.

7. A system as set forth in claim 6 wherein said channel is U-shaped and said cog is fixed on a shaft extending laterally beyond the legs of said channel.

8. A system as set forth in claim 7 further including crank means detachably engageable with said shaft for rotating said cog.

9. A system as set forth in claim 8 including J-shape projections at each vertical edge of said vertical with the bottom of the J flush with the open end of said channel.

10. A system as set forth in claim 9 wherein the long stem of each J-shape projection has an aperture axially aligned with said shaft for permitting attachment of said crank means to said shaft.

11. A system as set forth in claim 10 wherein said aperture is outwardly spaced from the respective end of said shaft.

12. A system as set forth in claim 1 including laterally directed edge flanges on each vertical flush with the open end of said channel.

13. A system as set forth in claim 12 wherein said vertical is bent to form said channel and edge flanges.

14. A system as set forth in claim 1 including vertical keeper means fixed in said channel for holding said strut in said channel for vertical movement.

15. A system as set forth in claim 14 wherein said channel is U-shape and said keeper means is U-shape and fixed top and bottom in said channel by pins passing through laterally aligned openings in the legs of said channel and keeper means.

16. A system as set forth in claim 15 wherein said strut includes vertically equally spaced holes and said drive means includes a cog journaled for rotation between the legs of said keeper means and cooperative with said holes to drive said strut vertically.

17. A system as set forth in claim 16 wherein said cog has an axial thickness less than the spacing between the legs of said channel and the legs of said keeper means are more narrow at said cog taking up the difference between such axial thickness and spacing so as to restrain the cog against axial movement.

18. A system as set forth in claim 1 wherein said panel includes metal face places each having a planar face and each being bent inwardly at adjacent vertical edges thereof to form respective web portions and then outwardly to form respective locating flanges, and said vertical includes webs on opposite sides of said channel butted against the corresponding web portions of said face plates, and respective means interconnecting said webs and central channel in butted locating engagement with the corresponding locating flanges of said face plates, and means securing said webs to corresponding web portions of said face plates.

19. A system as set forth in claim 18 wherein said vertical further includes vertically extending mounting flanges at the outer ends of said webs which are recessed in relation to said planar faces and adapted to be connected to like flanges of an adjacent panel.

20. A system as set forth in claim 19 wherein said channel is U-shape and said means interconnecting said webs and central channel includes a first portion extending outwardly from the corresponding leg of said channel and a second portion extending from said first portion to the corresponding web, said second portion being in butted locating engagement with the corresponding locating flange.

21. A system as set forth in claim 20 wherein said first portion is flush with said edge flange.

22. A system as set forth in claim 21 wherein said strut includes a series of equally spaced holes, said drive means comprises a cog journaled for rotation within said channel, said channel is U-shape and said cog is fixed on a shaft extending laterally beyond the legs of said channel and said second portions.

23. A system as set forth in claim 1 wherein said vertical includes an inwardly directed U-shape glazing channel and said shallow channel is formed by a channel element secured to the bottom of said glazing channel and facing in the opposite direction.

24. A system as set forth in claim 23 wherein said vertical includes laterally directed flanges flush with the open end of said shallow channel.

25. In a partition system, a panel, a vertical on each end of said panel, each vertical including a vertical channel, a strut positioned in each channel, drive means operative vertically to move said strut, and spring detent means captured in said channel by said strut and operative to hold said strut in vertically adjusted position.

26. A system as set forth in claim 25 wherein said strut includes a plurality of vertically spaced holes cooperative with said spring detent means to hold said strut in vertically adjusted position.

27. A system as set forth in claim 26 including means holding said spring detent against vertical movement in said channel.

28. A system as set forth in claim 27 wherein said spring detent means includes a vertically elongate spring element butted against the base of said channel, said spring element including at least one detent cooperative with said holes in said strut to hold said strut in vertically adjusted position, and said base of said channel being relieved from said spring element in the area of said detent so that said detent may be disengaged from a hole during vertical adjustment of said strut.

29. A system as set forth in claim 28 wherein such relief comprises an offset in the base of said channel.

30. A system as set forth in claim 28 wherein such relief comprises a hole in the base of said channel.

31. A system as set forth in claim 28 wherein said spring element includes at least two detents, and at least two corresponding reliefs in the base of said channel.

32. A system as set forth in claim 26 wherein said drive means cooperates with said holes to drive said strut vertically.

33. A system as set forth in claim 32 wherein said drive means comprises a cog journaled for rotation within said channel.

34. A unitary panel comprising a panel body, a panel foot telescopically received and movable in the bottom of said panel body, a panel head telescopically received and movable in the top of said panel body, means for vertically adjustably yet rigidly supporting said panel body on a floor independently of said panel foot, and panel head adjustment means at each end of said panel body for vertically adjusting the corresponding end of said panel head in relation to said panel body.

35. A panel as set forth in claim 34 further including means at each end of said panel body for resiliently urging the corresponding end of said panel foot downwardly in relation to said panel body.

36. A panel as set forth in claim 34 wherein each panel head adjustment means includes a vertical strut connected to the corresponding end of said panel head and means for vertically indexing said strut.

37. A panel as set forth in claim 36 wherein said panel body has a vertical channel at each end thereof and said strut is vertically guided in the corresponding channel.

38. A full height partition wall system comprising a panel, a vertically adjustable head or foot for said panel, a strut connected to said head or foot at at least one end thereof, and spring detent means to hold said strut in one of a plurality of vertically spaced positions, characterized by drive means for said strut in the end of such panel operative to drive the strut vertically to such vertically spaced positions.

39. A wall system as set forth in claim 38 wherein said drive means is concealed in the end of such panel.

40. A wall system as set forth in claim 38 wherein said drive means acts as a keeper to maintain said strut and spring detent in operative engagement.

41. A wall system as set forth in claim 38 including a drive shaft for said drive means, and means to apply power means to said drive shaft from the exterior of said panel to drive the strut vertically.

42. A wall system as set forth in claim 38 wherein said drive means comprises a cog and said strut means comprises a bar having equally vertically spaced holes therethrough adapted to be engaged by both said cog and said spring detent means.

43. A wall system as set forth in claim 42 wherein said strut means is confined within a channel between said spring detent means and said cog.

44. A wall system as set forth in claim 43 wherein said spring detent means is in the bottom of said channel and said cog is journaled between the legs of said channel.

45. A wall system as set forth in claim 44 including openings in the bottom of said channel opposite the detent of said spring means permitting the spring detent means to flex as the strut is driven therepast.

46. A wall system as set forth in claim 45 wherein said spring detent means includes at least two detents vertically spaced a multiple of the holes through the strut.

47. A wall system as set forth in claim 44 wherein said channel is one integral part of the vertical forming the vertical edge of said panel.

48. A wall system as set forth in claim 47 wherein said channel is secured to the upper portion of the vertical forming the edge of said panel.

49. A full height partition wall system comprising a panel with a vertically movable head panel and a vertically movable foot panel secured thereto and forming a part thereof adapted to be moved upwardly and downwardly respectively, to secure said panel to and directly against a ceiling and floor, respectively, a vertical at each end of said panel, and an adjustable foot secured to the bottom of each vertical, said foot panel being spring loaded against the bottom of each foot for movement with the bottom of each foot or movement independently against the spring loading.

50. A partition system as set forth in claim 49 wherein said panel extends below the bottom of said foot.

51. A partition system as set forth in claim 49 wherein each vertical includes a relatively shallow channel at the upper end thereof, and a strut vertically movable in said channel and connected to said head panel.

52. In an interior partition system supported on a floor, the combination of a partition panel, a telescoping foot in the bottom of said panel, means for vertically adjustably yet rigidly supporting said panel on the floor, and resilient means interposed between said panel and said foot for urging said foot downwardly into engagement with the floor, said foot being movable independently of said means for vertically adjustably yet rigidly supporting said panel on the floor against the urging force of said resilient means.

53. A combination as set forth in claim 52 wherein said means for supporting includes an adjusting screw threaded for vertical adjustment in the bottom of said panel at each end thereof.

54. A combination as set forth in claim 53 wherein said adjusting screw passes through said foot and guides said foot for vertical movement.

55. A combination as set forth in claim 54 wherein said panel has a depending projection threaded for receipt of said adjusting screw and said resilient means includes a spring abutting said projection and adjusting screw.

56. A combination as set forth in claim 54 further including stop means for maintaining said foot telescoped in said panel when not engaged with the floor.

57. In an interior partition system, a panel comprising metal face plates each having a planar face and each being bent inwardly at adjacent vertical edges thereof to form respective web portions and then outwardly from said web portions to form respective abutment flanges, and a vertical element on said adjacent vertical edges of said face plates, said vertical element including an outwardly opening central channel, inwardly opening channels on opposite sides of said central channel receiving said abutment flanges and holding them against separation, and a vertically extending recessed mounting flange at the outer vertical edge of each inwardly opening channel adapted to be mounted against a like flange of an adjacent panel.

58. A panel as set forth in claim 57 wherein said central and inwardly opening channels are U-shape and the legs of said central channel form the inner legs of said inwardly opening channels.

59. A panel as set forth in claim 58 wherein said web portions are perpendicular to said faces.

60. A panel as set forth in claim 59 wherein said mounting flanges of said vertical element are connected to and spaced from said inwardly opening channels by respective webs butted against the corresponding web portions of said face plates.

61. A panel as set forth in claim 60 including means securing said webs of said vertical element to the corresponding web portions of said face plates.

62. A panel as set forth in claim 57 including a strut positioned in each said outwardly opening central channel and supporting one end of an adjustable panel head, and drive means in each said central channel operative vertically to move the respective strut and thus said head.

* * * * *